US008989630B2

(12) United States Patent
Ohshima

(10) Patent No.: US 8,989,630 B2
(45) Date of Patent: Mar. 24, 2015

(54) CONDUCTIVE MEMBER, PROCESS CARTRIDGE, AND IMAGE FORMING APPARATUS

(71) Applicant: Tadayuki Ohshima, Kanagawa (JP)

(72) Inventor: Tadayuki Ohshima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/069,860

(22) Filed: Nov. 1, 2013

(65) Prior Publication Data

US 2014/0133888 A1 May 15, 2014

(30) Foreign Application Priority Data

Nov. 15, 2012 (JP) ..... 2012-251418

(51) Int. Cl.
*G03G 15/02* (2006.01)
*G03G 15/16* (2006.01)

(52) U.S. Cl.
CPC ..... *G03G 15/0233* (2013.01); *G03G 15/1685* (2013.01)
USPC ..... 399/176

(58) Field of Classification Search
USPC ..... 399/176
See application file for complete search history.

(56) References Cited

U.S. PATENT DOCUMENTS

| | | | | |
|---|---|---|---|---|
| 7,756,439 | B2 * | 7/2010 | Kosuge et al. | 399/100 |
| 2006/0062598 | A1 * | 3/2006 | Namiki et al. | 399/176 |
| 2009/0142099 | A1 | 6/2009 | Oshima | |
| 2014/0133888 | A1 * | 5/2014 | Ohsima | 399/176 |

FOREIGN PATENT DOCUMENTS

| | | |
|---|---|---|
| JP | 7-005745 | 1/1995 |
| JP | 2009-134050 | 6/2009 |
| JP | 2009-242810 | 10/2009 |
| JP | 2011-028052 | 2/2011 |

* cited by examiner

*Primary Examiner* — W B Perkey
(74) *Attorney, Agent, or Firm* — Oblon, McClelland, Maier & Neustadt, L.L.P.

(57) ABSTRACT

A conductive member includes a conductive supporting body and an electrical resistance adjustment layer laminated on the conductive supporting body and comprising a resin composition. The resin composition comprises a thermoplastic resin having an ether group as a component of a resin matrix, and at least a polyketone fiber and an electrolytic salt are dispersed within the resin matrix.

8 Claims, 4 Drawing Sheets

CONDUCTIVE MEMBER, PROCESS CARTRIDGE, AND IMAGE FORMING APPARATUS

CROSS-REFERENCE TO RELATED APPLICATIONS

This patent application is based on and claims priority pursuant to 35 U.S.C. §119 from Japanese Patent Application No. 2012-251418, filed on Nov. 15, 2012 in the Japan Patent Office, which is hereby incorporated by reference herein in its entirety.

BACKGROUND

1. Technical Field

The present disclosure generally relates to a conductive member employed as a charging member or a transfer member provided near an image carrier, a process cartridge including the conductive member, and an image forming apparatus employing an electrophotographic method, such as a copier, a laser-beam printer, or a facsimile machine, and including the conductive member.

2. Related Art

A conductive member may be employed as a charging member to charge an image carrier (e.g., photoconductor) or a transfer member to transfer toner on an image carrier in an image forming apparatus employing an electrophotographic method, such as a copier, a laser-beam printer, or a facsimile machine.

The following is a description of a configuration and action of a process cartridge of an image forming apparatus (e.g., printer) employing a conductive member as a charging member.

FIG. 1 is a schematic view of an image forming apparatus employing an electrophotographic method. In FIG. 1, the image forming apparatus includes an image carrier 11 (i.e., electrostatic latent image carrier), a charging member 12 (i.e., charging roller) that implements charging provided near or in contact with the image carrier 11, and an exposure 13 by a laser light or a reflected light from a manuscript. Further, the image forming apparatus includes a toner carrier 14 (i.e., developing roller) that attaches a toner 15 to an electrostatic latent image on the image carrier 11 and a transfer member 16 (i.e., transfer roller) that transfers a toner image on the image carrier 11 to a recording medium 17. The image forming apparatus also includes a cleaning member 18 (i.e., blade) for cleaning the image carrier 11 after transfer, a developing device 20, and a cleaning device 21. The image forming apparatus also includes discarded toner 19 generated by removal of residual toner on the image carrier 11 with the cleaning member 18.

In FIG. 1, functional units are illustrated for description and other units are omitted for simplicity.

The image forming apparatus forms an image as follows.

1. The charging roller (i.e., charging member) charges a surface of the image carrier to a desired potential.

2. An exposure device irradiates an image light onto the image carrier to form an electrostatic latent image corresponding to a desired image on the image carrier.

3. The developing roller develops the electrostatic latent image with toner and forms a toner image (visible image) on the image carrier.

4. The transfer roller transfers the toner image from the image carrier to the recording medium.

5. The cleaning device cleans non-transferred residual toner on the image carrier.

6. The transfer roller conveys the recording medium with the transferred toner image to a fixing device not shown in FIG. 1. The fixing device fixes the toner image on the recording medium with heat and pressure.

A desired image is formed on the recording medium by repeating steps 1 to 6.

In the above description, a contact charging method in which the charging roller contacts the image carrier is described as a charging method employing the charging roller.

However, the contact charging method has the following problems.

1. Trace of the charging roller (which occurs as a material constituting the charging roller seeps out and adheres to a surface of a charging target body).

2. Charging sound (which occurs due to vibration of the charging roller contacting the charging target body when an alternating-current voltage is applied to the charging roller).

3. Decline in charging performance due to the toner on the image carrier adhering to the charging roller (which occurs, in particular, as the above-described seeping out is likely to cause such toner adherence).

4. Adherence of the material constituting the charging roller to the image carrier.

5. Permanent deformation of the charging roller caused when the image carrier stops for a long period.

In view of the above-described problems, for example, JP-H03-240076-A, JP-H04-358175-A, and JP-H05-107871-A proposes a proximity charging method in which the charging roller is provided near the image carrier. JP-2005-091818-A also describes a configuration in which space maintaining members are press fit into both ends of a resistance adjustment layer and simultaneous processing (removal processing) of the space maintaining members and the resistance adjustment layer to allow precise control of a space.

The required characteristics of the charging roller employed in the proximity charging method differs from the required characteristics of the above-described charging roller employed in the contact charging method. The charging roller generally used in the contact charging method has a configuration of an elastic body, such as vulcanized rubber, coating the circumference of a metal core. In the contact charging method, the charging roller needs to uniformly contact the image carrier to charge the image carrier uniformly.

If the charging roller formed of the above-described elastic body is used in the proximity charging method, the following problems occur.

1. It is necessary to bring the charging roller into proximity of the image carrier with a space between the charging roller and the image carrier being maintained by the space maintaining members, such as spacers, provided in non-image forming areas at both ends of the charging roller. However, when the charging roller formed of the elastic body is employed, deformation of the elastic body makes it difficult to maintain a uniform space. As a result, charging potential variation and unevenness of image due to the charging potential variation may occur.

2. The vulcanized rubber forming the elastic body is susceptible to wear and deformation after long-term use, which results in fluctuations of the space over time.

To overcome the above-described problems, it is conceivable to employ a thermoplastic resin, which is a non-elastic body, for the charging roller employed in the proximity charging method. Such a configuration allows the space between the charging roller and the image carrier to be maintained uniform.

A mechanism for charging the surface of an image carrier drum with the charging roller is known to be micro discharge between the charging roller and the image carrier drum according to Paschen's Law. For the image carrier drum to acquire the function to maintain a desired charging potential, the resistance value of the thermoplastic resin needs to be controlled within a semi-conductivity range of approximately $10^6$ Ωcm to $10^9$ Ωcm.

As a method of controlling the resistance value, the method of mixing and dispersing a conductive pigment such as carbon black within a thermoplastic resin matrix is typically employed. However, when the resistance adjustment layer employing the conductive pigment is set within the semi-conductivity range, the resistance value may greatly fluctuate and image defects, such as partial charge failure, may occur.

Another method to control the resistance value is employing an ion conductive material such as electrolytic salt. The ion conductive material disperses at a molecule level within a resin matrix. Compared to the case of dispersing the conductive pigment, the resistance value variation is small and decline in image quality due to the resistance value variation is overcome.

However, low molecular weight ion conductive material such as electrolytic salt has a tendency to bleed out on the surface of the resin matrix. When the ion conductive material bleeds out onto the surface of the charging roller, a fixation of the toner is generated and image defect occurs.

To overcome the bleeding out of the ion conductive material, employing a solid state polymer ion conductive material such as a polyether ester amide is conceivable. By employing the solid state polymer ion conductive material, the ion conductive material is dispersed and fixed within the resin matrix and bleeding out of the ion conductive material onto the surface is less likely. However, the addition of only the polymer ion conductive material makes the resistance value of the resistance adjustment layer high and controlling the resistance value to the semi-conductivity range is not possible. Therefore, a method of adding the electrolytic salt to the polymer ion conductive material is employed to impart sufficient conductivity. Specific examples of widely used electrolytic salts include perchlorates (e.g., sodium perchlorate, lithium perchlorate) and organic anion salts containing fluorine (e.g., lithium trifluoromethanesulfonate).

However, the polymer ion conductive material itself generally has a high water absorbing property. Thus, when the polymer ion conductive material is added to a material, the volume expansion rate (i.e., swelling properties) by water absorption of the material becomes high. Water is in the intervening air of conduction path. Accordingly, when the polymer ion conductive material is employed in the resistance adjustment layer of the charging roller in the proximity charging method, the change of the space between the charging roller and the image carrier due to the environment becomes large and charging properties decline leading to image defects.

More specifically, under high temperature and high humidity environments, the charging roller swells and the space between the charging roller and the image carrier declines. In extreme cases, the charging roller and the image carrier contacts each other. Using the charging roller under high temperature and high humidity environments for a long period results in the transfer and adherence of discharge products on the image carrier to the charging roller side, and conductivity at sections to which the discharge products adhere to decline. As a result, image defects occur. In addition, under low temperature and low humidity environments, the space becomes large and discharge from the charging roller to the image carrier becomes non-uniform leading to image defects.

It is possible to reduce swelling properties of the charging roller by increasing the mixing ratio of the thermoplastic resin with insulation properties within the resistance adjustment layer, or by adjusting the ratio of functional groups contributing to water absorbability of the polymer ion conductive material. The material of the charging roller obtains low water absorption properties reducing swelling. However, at the same time, resistance increase occurs and necessary conductivity for the charging roller cannot be obtained.

JP-2009-134050-A describes a technology to mix a fiber formed of a polymer having an aromatic skeleton in the molecule and having the same insulation properties as the thermoplastic resin that does not melt when forming the charging roller. With the technology, reduction of water absorbability is obtained without generating resistance increase as in the case of increasing the mixing ratio of the thermoplastic resin. As a result, reduction of swelling properties while maintaining the conductivity of the charging roller is obtained, and an effect of no generation of image defects caused by the change in the space between the charging roller and the image carrier due to the environment is obtained.

However, obtaining constant stable high surface precision quality without variation even with cutting processes and grinding processes is difficult with the technology of JP-2009-134050-A. Further, the fiber formed of a polymer having an aromatic skeleton in the molecule is generally expensive and increases the cost of the conductive member. Keeping down the cost is desired.

SUMMARY

In view of the foregoing, in an aspect of this disclosure, there is provided a novel conductive member including a conductive supporting body and an electrical resistance adjustment layer laminated on the conductive supporting body. The conductive member includes a resin composition, wherein the resin composition includes a thermoplastic resin having an ether group as a component of a resin matrix, and at least a polyketone fiber and an electrolytic salt are dispersed within the resin matrix.

The aforementioned and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
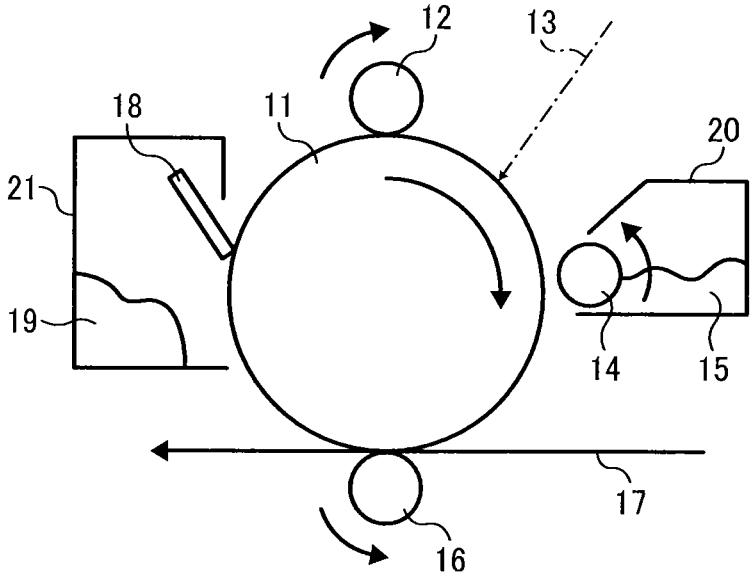
FIG. 1 RELATED ART
FIG. 1 is a schematic view of an image forming apparatus.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In view of the foregoing, in an aspect of this disclosure, there is provided a novel conductive member in which material cost is low, stable high surface precision without variation is obtained, and low resistance and low water absorption of a resistance adjustment layer is obtained Referring now to the drawings, exemplary embodiments of the present disclosure are described below.

Figure 2:
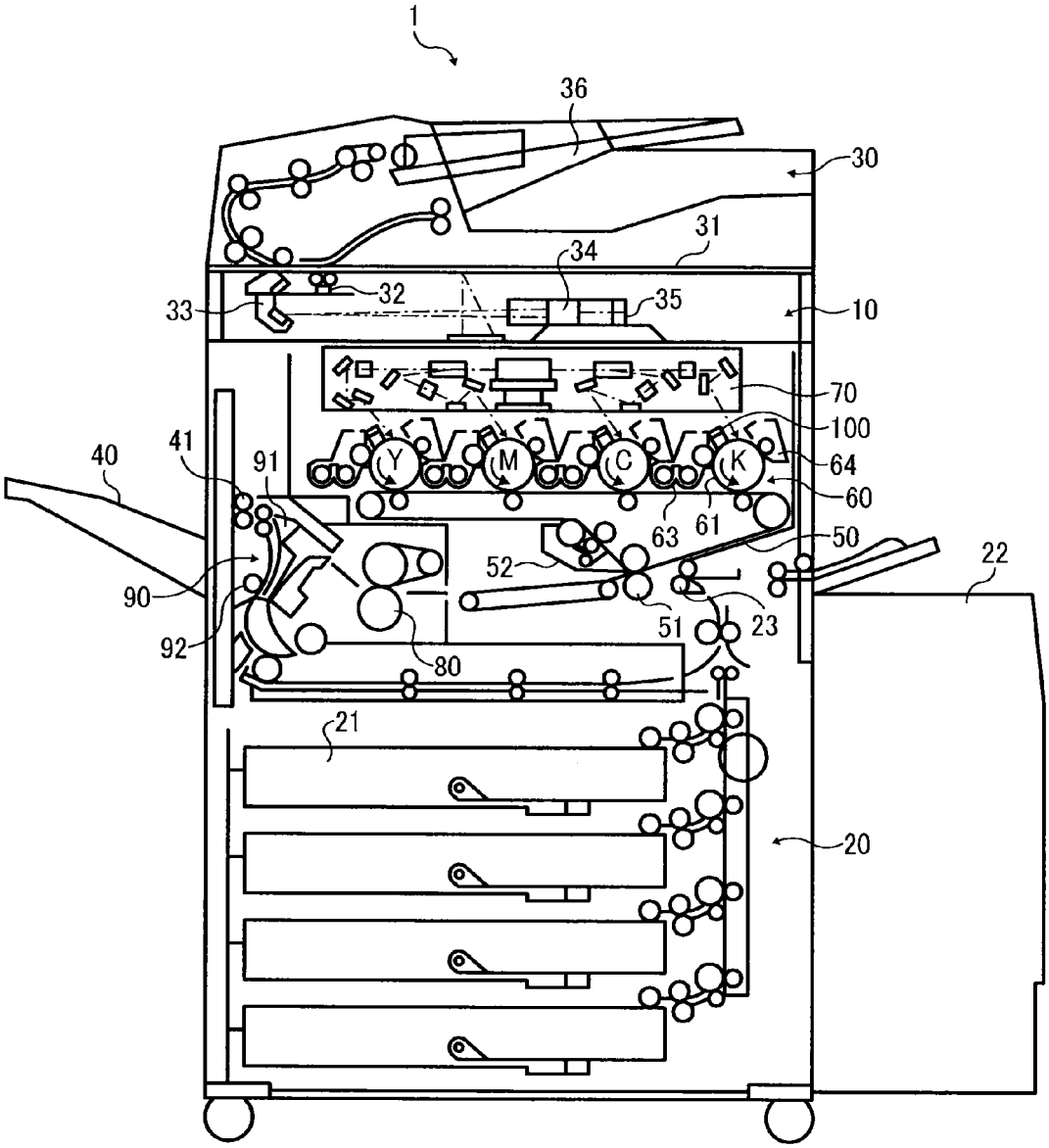
FIG. 2 is a schematic view of a configuration of an image forming apparatus including a charging device employing a conductive member according to an embodiment of the present invention as a charging member, and a process cartridge.
Figure 3:
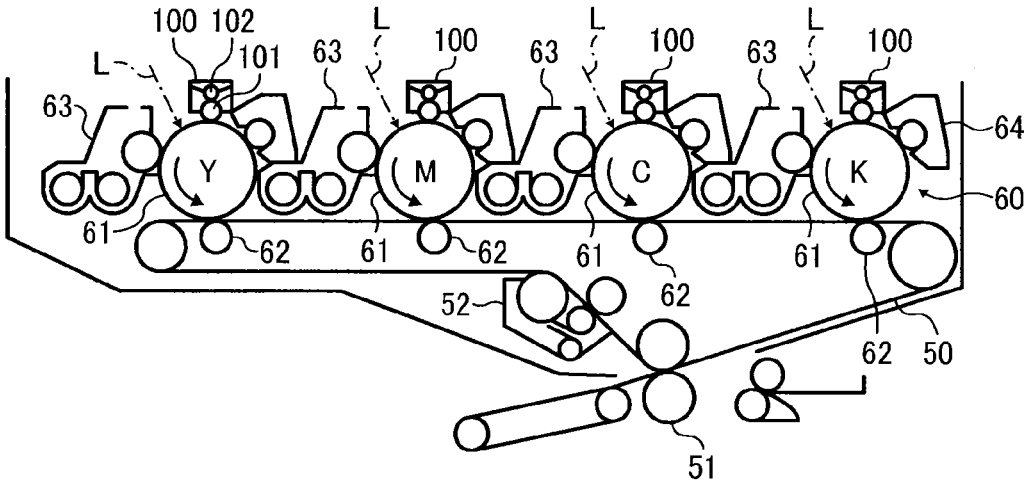
FIG. 3 is a schematic view of an image forming member of the image forming apparatus of FIG. 2.

FIG. 2 is a schematic view of a configuration of an image forming apparatus including a charging device employing a conductive member according to an embodiment of the present invention as a charging member, and a process cartridge. FIG. 3 is a schematic view of an image forming member of the image forming apparatus of FIG. 2. The image forming apparatus 1 includes an image carrier 61, a charging device 100, an exposure device 70, a developing device 63, a primary transfer device 62, a belt shaped intermediate transfer member 50, a secondary transfer device 51, a fixing device 80, and a cleaning device 64. The image carrier 61 is a drum shape including a photosensitive layer on the surface. One image carrier 61 for each of the four colors of yellow (Y), magenta (M), cyan (C), and black (K) is included. The charging device 100 of each image carrier 61 charge each image carrier 61 uniformly. The exposure device 70 forms an electrostatic latent image on each charged image carrier 61 by exposing a laser light on each charged image carrier 61. The developing device 63 of each image carrier 61 contains a developer of one of the four colors yellow (Y), magenta (M), cyan (C), or black (K). Each developing device 63 develops a toner image corresponding to the electrostatic latent image on each image carrier 61. The primary transfer device 62 of each image carrier 61 transfers each toner image on each image carrier 61. Each toner image on each image carrier 61 is transferred to the belt shaped intermediate transfer member 50 superimposed over each other forming a composite toner image of the four colors. The secondary transfer device 51 transfers the composite toner image of the four colors on the intermediate transfer member 50 to a recording medium. The fixing device 80 fixes the composite toner image of the four colors transferred from the intermediate transfer member 50 onto the recording medium. The cleaning device 64 of each image carrier 61 removes residual toner on each image carrier 61 after transfer.

The recording medium is stored in a feeding device 21 or 22. The recording medium is fed sheet-by-sheet from the feeding device 21 or 22 to a conveyance path. The recording medium is conveyed via the conveyance path to a pair of registration rollers 23 with a conveyance roller. The recording medium is conveyed from the pair of registration rollers 23 to a transfer section at a timing in sync with the transfer of the toner image on the image carrier 61.

The exposure device 70 in the image forming apparatus 1, as shown in FIG. 2, irradiates a light L (refer to FIG. 3) to the image carrier 61 charged by the charging device 100 and forms the electrostatic latent image on the image carrier 61 having photoconductive properties. The light L may be an optical light emitted from a lamp such as a fluorescent light tube or a halogen lamp, or a semiconductor element such as a light emitting diode (LED) or a laser diode (LD). In a case in which the light L is irradiated in synchronization with a rotation speed of the image carrier 61 with a signal from an image processing member not shown in FIG. 2 or FIG. 3, the employed element is the LD.

The developing device 63 includes a developer carrier. A toner stored in the developing device 63 is conveyed by a supplying roller to a stirring member. The toner is mixed and stirred with the developer including a carrier, and conveyed to a developing area opposite the image carrier 61. The positive or negative charged toner transfers to the electrostatic latent image on the image carrier and develops the electrostatic latent image. The developer may be a magnetic or non-magnetic one component developer, or a combination of both. The developer also may be a wet type developing fluid.

The primary transfer device 62 forms an electric field with a polarity opposite the polarity of the toner at the back side of the intermediate transfer member 50 and transfers the toner image developed on the image carrier 61 to the intermediate transfer member 50. The primary transfer device 62 may be a corona transfer device such as a corotron or a scorotron, or a transfer device such as a transfer roller or a transfer brush. After transfer, in synchronization with the recording medium conveyed from the feeding device 22, the secondary transfer device 51 then transfers the toner image to the recording medium conveyed from the feeding device 22. It is to be noted that a method of directly transferring to the recording medium may be employed instead of the method of transferring via the intermediate transfer member 50.

The fixing device 80 fixes the toner image on the recording medium onto the recording medium with the application of heat and/or pressure. The fixing is implemented by passing the recording medium between a pair of pressing/fixing rollers. When the recording medium is passing between the pair of pressing/fixing rollers, heat and pressure is applied. The toner image is fixed onto the recording medium with the melting of a binding resin of the toner. The fixing device 80 may be a belt configuration instead of the roller configuration or may implement fixing with heat irradiation such as with a halogen lamp. The cleaning device 64 of the image carrier 61 cleans and removes residual toner on the image carrier 61 after transfer to enable the formation of the next image. The cleaning device 64 may be a device with a blade made of rubber such as urethane or a fur brush made of fiber such as polyester.

The following is a description of the action of the image forming apparatus 1 according to an embodiment of the present invention. In a reading member 30, a document to be read is set on a document platform of a document conveying member 36. Alternatively, the document to be read may be set on a contact glass 31 by opening the document conveying member 36 placing the document to be read on the contact glass 31 and closing the document conveying member 36 to hold down the document to be read. After a start button not shown in FIG. 2 or FIG. 3 is pressed, a control member of the image forming apparatus 1 not shown in FIG. 2 or FIG. 3 conveys the document onto the contact glass 31 if the document is set on the document conveying member 36 and starts a first reading travelling member 32 and a second reading travelling member 33 that travels along the document on the contact glass 31. The control member immediately starts the first reading travelling member 32 and the second reading travelling member 33 if the document is set on the contact glass 31. The first reading travelling member 32 emits a light from a light source in the first reading travelling member 32. The light is reflected back from the surface of the document to the first reading travelling member 32 and the reflected light is then directed to the second reading travelling member 33. In the second reading travelling member 33, the reflected light is directed by a mirror in the second reading travelling member 33 to a charge-coupled device (CCD) 35 serving as a reading sensor through an image formation lens 34, and image information is read. The read image information is sent to the control member. Based upon the received image information from the reading member 30, the control member controls the LD or LED not shown in FIG. 2 or FIG. 3 provided in the exposure device 70 of an image forming member 60 and irradiates the light L towards the image carrier 61 for writing. The electrostatic latent image is formed on the surface of the image carrier 61 by the irradiation of the light L.

A sheet feeding member 20 feeds the recording medium with feeding rollers from one of a plurality of cassettes of the feeding device 21. The fed recording medium is separated by a separating roller and conveyed to the conveyance path. The recording medium is conveyed by the conveyance roller of the conveyance path to a feed path of the image forming member 60. A manual feeding of the recording medium is possible other than the feeding of the sheet feeding member 20 in the image forming apparatus 1. A manual feed tray for feeding manually and a separating roller for separating the recording medium sheet-by-sheet and feeding the recording sheet towards a manual feed path are provided on the side face of the image forming apparatus 1. The pair of registration rollers 23 ejects a single sheet of the recording medium stacked in the plurality of cassettes of the feeding device 21 and conveys the single sheet of the recording medium to a secondary transfer section between the intermediate transfer member 50 and the secondary transfer device 51. In the image forming member 60, when the image information is received from the reading member 30, the above-described laser writing and developing process are implemented to form the toner image on the image carrier 61.

The developer in the developing device 63 is captured and retained by a magnetic polarity not shown in FIG. 2 or FIG. 3 and forms a magnetic brush on the developer carrier. The developer transfers from the developer carrier to the image carrier 61 by a developing bias voltage applied to the developer carrier and makes the electrostatic latent image on the image carrier 61 visible developing the toner image. The developing bias voltage is configured of an alternating current (AC) current voltage superimposed on a direct current (DC) voltage.

The control member then starts at least one of the feeding rollers of the sheet feeding member 20 to feed the recording medium in accordance with the size of the toner image. In addition, in accordance with the start of the feeding roller, a driving motor is started to rotationally drive a single support roller and rotate two other following support rollers to rotationally convey the intermediate transfer member 50. At the same time, the image carrier 61 in each image forming unit is rotated. A single color image of each color Y, M, C, and K is formed on each image carrier 61, respectively. Along with the rotational conveyance of the intermediate transfer member 50, the single color images are sequentially superimposed over each other on the intermediate transfer member 50 forming a composite toner image of four colors.

In addition, the control member selectively rotates one feeding roller of the sheet feeding member 20, feeds the recording medium from one of the plurality of cassettes of the feeding device 21, separates the recording medium sheet-by-sheet with the separating roller and conveys the recording medium to the conveyance path, and guides the recording medium to the feed path of the image forming member 60 in the image forming apparatus 1. The recording medium is stopped by bumping the recording medium into the pair of registration rollers 23. The pair of registration rollers 23 is rotated in sync with the transfer timing of the composite toner image of four colors on the intermediate transfer member 50. The recording medium is then conveyed to the secondary transfer section that is a contact section between the intermediate transfer member 50 and the secondary transfer device 51. The composite toner image of four colors is secondarily transferred to the recording medium by a secondary transfer bias formed at the secondary transfer section and a contact pressure, and the composite toner image of four colors is recorded onto the recording medium. It is preferable that the secondary transfer bias is DC. The recording medium after transfer of the composite toner image of four colors is conveyed to the fixing device 80 by a conveyance belt of the secondary transfer device. The composite toner image of four colors is fixed onto the recording medium with the application of heat and pressure by the pair of pressing rollers and ejected on an ejection tray 40 with a pair of ejection rollers 41.

Figure 4:
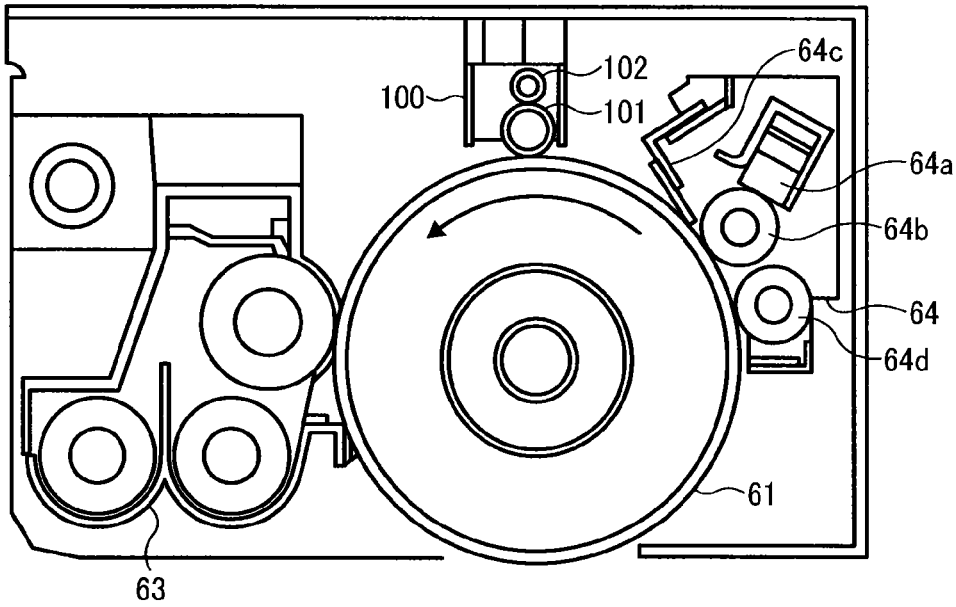
FIG. 4 is a schematic view of a configuration of a charging device and a process cartridge according to an embodiment of the present invention.

The following is a description of a case in which the conductive member according to an embodiment of the present invention is employed as the charging member in the above-described image forming apparatus employs with reference to FIG. 4 illustrating the charging device 100. FIG. 4 is a schematic view of a configuration of a charging device and a process cartridge according to an embodiment of the present invention. The process cartridge includes at least the image carrier 61, the charging device 100, and the cleaning device 64. As illustrated in FIG. 4, the developing device 63 can be included as well. The process cartridge as a whole is removably installable in the image forming apparatus.

The following is a description with reference to FIG. 4. The surface of the image carrier 61 is charged uniformly by the charging member provided not contacting an image forming area, after forming the electrostatic latent image and developing that makes the electrostatic latent image visible, the toner image is transferred to the recording medium. The residual toner on the image carrier 61 that did not transfer to the recording medium is collected by an auxiliary cleaning member **64*d*. After collection of the residual toner, a solid lubricant 64*a* is applied uniformly to the surface of the image carrier 61 with an application member 64*b* forming a lubricant layer to prevent the adhesion of the toner or a toner constituting material to the surface of the image carrier 61. After forming the lubricant layer, a cleaning member 64*c* collects toner that the auxiliary cleaning member 64*d* was unable to collect and conveys the toner to a discarded toner collection member. The auxiliary cleaning member 64*d* may be a roller shape or a brush shape. The solid lubricant 64*a* may be any solid lubricant as long as friction coefficient of the surface of the image carrier 61 is decreased and non-adhesion property is imparted. For example, a metal salt of a fatty acid such as zinc stearate or polytetrafluoroethylene. The cleaning member 64***c* may be a blade made of rubber such as silicone or urethane, or a fur brush made of fiber such as polyester.

The charging device 100 includes a charger cleaning member 102 to remove contamination. The shape of the charger cleaning member 102 may be a roller shape or a pad shape. The shape of the charger cleaning member 102 in an embodiment of the present invention is the roller shape. The charger cleaning member 102 is fitted to a shaft provided in a housing of the charging device 100 not shown in FIG. 4 and is supported rotatably on the shaft. The charger cleaning member 102 contacts a charging member 101 and cleans the outer circumference surface of the charging member 101. If an extraneous material such as the toner, paper particles, or broken materials of members adhere to the surface of the charging member 101, abnormal discharge occurs due to an electric field concentrating around the extraneous material generating prioritized discharge. If an extraneous material with electrical insulation properties adheres in a wide range to the surface of the charging member 101, charging spots is generated on the image carrier 61 due to no discharge in areas with the extraneous material. Therefore, it is preferable that the charger cleaning member 102 for cleaning the surface of the charging member 101 is included in the cleaning device 100 as described above. The charger cleaning member 102 may be a brush made of fiber such as polyester, or a porous item such as a sponge made of melamine resin. The charger cleaning member 102 may be rotated in a form in which the charger cleaning member 102 is rotated by the rotation of the charging member 101, the rotation having a difference in linear velocity, and the charger cleaning member 102 separates when cleaning is completed.

The charging device 100 includes a power source not shown in FIG. 4 to apply a voltage to the charging member 101. The applied voltage may be only a DC voltage though it is preferable that the applied voltage is an AC voltage superimposed on the DC voltage (hereinafter referred to as superimposed voltage). In a case in which a layer configuration of the charging member 101 includes a non-uniform section, a non-uniform surface potential of the image carrier 61 may occur when only the DC voltage is applied. If the superimposed voltage is applied, the surface of the charging member 101 becomes equipotential and discharge can stably charge the image carrier 61 uniformly. It is preferable that the AC voltage in the superimposed voltage makes a voltage between peaks two times or more of a charging start voltage of the image carrier 61. The charging start voltage is, in a case of applying only the DC voltage to the charging member 101, an absolute value of a voltage at the start of charging of the image carrier 61. As a result, a reverse discharge from the image carrier 61 to the charging member 101 is generated and due to the leveling effect of the reverse discharge, the image carrier 61 can be charged uniformly in a further stable state. In addition, it is preferable that a frequency of the AC voltage is seven times or more of a process speed of the image carrier 61. By making the frequency seven times or more, moire images become visually unrecognizable.

In the embodiment of the present invention, the auxiliary cleaning member 64*d* is a brush roller and the solid lubricant 64*a* is zinc stearate formed into a block shape. The brush roller serving as an application member is pressed by a pressing member such as a spring. With the above-described configuration, the brush roller applies the solid lubricant 64*a* scraped from the solid lubricant 64*a* block to the image carrier 61.

The cleaning member 64*c* is an urethane blade contacting the surface of the image carrier 61 in a direction counter to the rotation of the image carrier 61. The charger cleaning member 102 of the charging member 101 is a sponge roller made of melamine resin and by employing a method of being rotated by the charging member 101, good cleaning of contamination on the surface of the charging member 101 is obtained.

Figure 5:
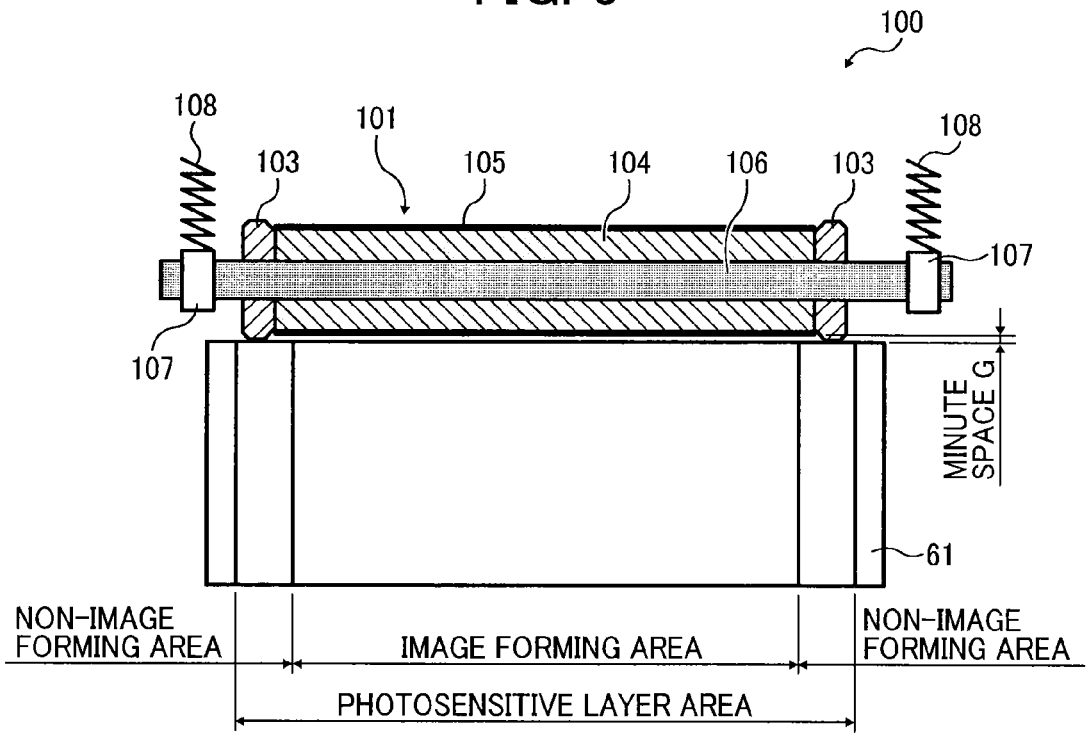
FIG. 5 is a schematic view illustrating positional relation of the charging member as the conductive member according to an embodiment of the present invention, a photosensitive layer area of an image carrier, an image forming area, and a non-image forming area.

FIG. 5 is a schematic view illustrating positional relation of the charging member as the conductive member according to an embodiment of the present invention, a photosensitive layer area of the image carrier, an image forming area, and a non-image forming area. The charging device 100 includes a charging member 101, the charger cleaning member 102, a power source not shown in FIG. 5, and a pressing spring 108. The charging member 101 is provided opposite the image carrier 61 with a minute space G. The charger cleaning member 102 cleans the charging member 101. The power source not shown in FIG. 5 applies voltage to charging member 101. The pressing spring 108 biases the charging member 101 into near contact with the image carrier 61.

As shown in FIG. 4 and FIG. 5, the charging member 101 is provided opposite the image carrier 61 maintaining the minute space G. The minute space G between the charging member 101 and the image carrier 61 is formed as follows. A space maintaining member 103 is provided at both ends of a later-described electrical resistance adjustment layer 104 of the charging member 101. The space maintaining member 103 contacts the non-image forming area at both ends outside of the image forming area within the photosensitive layer area, and the minute space G is formed. Accordingly, by contacting the space maintaining member 103 in the photosensitive layer area, even if the coating thickness of the photosensitive layer varies, variation of the minute space G is prevented.

As shown in FIG. 5, the charging member 101 includes the space maintaining member 103. The following is a description of the function of the space maintaining member 103 when the space maintaining member 103 is disposed opposite the image carrier 61 of the image forming apparatus. The space maintaining member 103 provided at both ends of the electrical resistance adjustment layer 104 formed on a conductive supporting body 106 contacts the image carrier 61 and maintains a constant space between the surface of the charging member 101 and the image carrier 61. On the surface of the electrical resistance adjustment layer 104 is formed a surface layer 105 to make the toner and toner additives less likely to adhere.

The shape of charging member 101 is not limited to a cylinder shape (i.e., roller shape) as shown in FIG. 5 and may be a belt shape, blade (i.e., plate) shape, or a semi-cylinder shape, and may also be provided in a fixed state. In addition, the cylinder shape charging member 101 may be rotatably supported by a gear or a bearing at both ends of the charging member 101. The charging member 101 charges the image carrier 61 more uniformly by being formed at a curved surface in which the image carrier 61 gradually separates from a nearest point to the image carrier 61 in an upstream to downstream direction of movement. If the charging member 101, opposite the image carrier 61, has a sharp portion, the potential of the sharp portion is higher and prioritized discharge starts at the sharp portion making uniform charging of the image carrier 61 difficult. Therefore, by employing the cylinder shape having curved surfaces, uniform charging of the image carrier 61 is obtained. The surface of the charging member 101 receives a strong stress due to discharge always being generated at a same surface. Degradation is advanced and in some cases, the surface of the charging member 101 is shaved off. If the whole surface of the charging member 101 may be used as the discharge surface, rotation will prevent early degradation and long-term use is obtained.

It is preferable that the minute space G in between the charging member 101 and the image carrier 61 maintained by the space maintaining member 103 is less than 100 μm, more preferably in a range of approximately 5 μm to 70 μm. As a result, the formation of abnormal images at starting operation of the charging device 100 is inhibited. If the minute space G is too large, the distance to reach the image carrier 61 is longer and a discharge starting voltage is larger according to Paschen's Law. Furthermore, a discharge space to the image carrier 61 becomes larger. As a result, to charge the image carrier 61 to a predetermined charge, a large amount of discharge products formed by discharge is needed. After image formation, a large amount of discharge products reside in the discharge space and adhere to the image carrier 61 causing advancement of temporal degradation of the image carrier 61. If the minute space G is too small, the distance to reach the image carrier 61 is shorter and the image carrier 61 is charged even with small discharge energy. However, the space formed between the charging member 101 and the image carrier 61 is narrower resulting in the flow of air being smaller. Accordingly, discharge products formed in the discharge space reside in the discharge space and like the case of the minute space G being too large, after image formation, a large amount of discharge products reside in the discharge space and adhere to the image carrier 61 causing advancement of temporal degradation of the image carrier 61. Thus, it is preferable to form a space in which the discharge energy is small and little discharge products is generated, and the space being to a degree that the air does not reside in the space. By setting the minute space G as described above, the generation of streamer discharge is prevented, the amount of generated discharge products is small which in turn makes the amount of the discharge products accumulated on the image carrier 61 small, and spot shaped image spots and image deletion is prevented.

The residual toner on the image carrier 61 after development is cleaned by the cleaning device 64 provided opposite the image carrier 61. However, completely removing all residual toner is difficult. A small degree of toner passes the cleaning device 64 and the toner is conveyed to the charging device 100. If a particle diameter of the toner is larger than the minute space the toner takes on heat due to sliding friction by the rotating image carrier 61 and the charging member 101, and adheres to the charging member 101. The portion in which the toner adhering on the charging member 101 is closer to the image carrier 61, and abnormal discharge in which prioritized discharge is generated occurs. Therefore, it is preferable that the above-described minute space G is larger than the maximum particle diameter of the toner employed in the image forming apparatus 1.

The charging member 101 is provided on the bearing fitted to a side plate of the housing of the charging device 100 not shown in FIG. 5. The charging member 101 is biased towards the direction of the surface of the image carrier 61 by the pressing spring 108 provided at a bearing 107 formed of a resin with a low friction coefficient and does not follow the movement of the bearing fitted to the side plate of the housing. With the above-described configuration, a constant minute space G is stably formed even if mechanical vibration or a deviation of a metal core occurs. It is preferable that a load for biasing is 4N to 25N, more preferably 6N to 15N. The size of the minute space G varies even if the charging member 101 is fixed by the bearing 107 due to vibration of rotation, eccentricity of the charging member 101, and the irregularity of the surface of the charging member 101. Accordingly, a case in which the minute space G is out of an appropriate range may occur, leading to advancement of temporal degradation of the image carrier 61. The load is defined as all load applied to the image carrier 61 via the space maintaining member 103. The load can be adjusted by controlling strength of the pressing spring 108 provided at both ends of the charging member 101, and controlling weight of the charging member 101 or the charger cleaning member 102. If the load is too small, suppressing variation in rotation of the charging member 101 and jumping due to impact strength of a driving gear is difficult. If the load is too large, friction between the charging member 101 and the fitted bearing 107 increases, and may lead to advancement of variation in rotation due to increasing the amount of wear temporally. Therefore, by maintaining the load in the above-described range, the minute space G is maintained in an appropriate range, operating life of the image carrier 61 is extended by decreasing the amount of generated discharge products which in turn decreases the amount of the discharge products accumulated on the image carrier 61, and spot shaped abnormal images and image deletion is prevented.

At least one portion of the space maintaining member 103 having a height difference to the electrical resistance adjustment layer 104 is higher than the electrical resistance adjustment layer 104. The portion of the space maintaining member 103 higher than the electrical resistance adjustment layer 104 contacts the image carrier 61. Methods of forming the height difference may be removal processes such as cutting and grinding the electrical resistance adjustment layer 104 and the space maintaining member 103 simultaneously. By processing simultaneously the electrical resistance adjustment layer 104 and the space maintaining member 103, high precision formation of the above-described minute space G is possible.

It is preferable to form the height of a portion of the space maintaining member 103 adjacent to the electrical resistance adjustment layer 104, the same height as the electrical resistance adjustment layer 104 or lower. With the above-described configuration, a contact width between the space maintaining member 103 and the image carrier 61 is reduced and the minute space G can be formed with more high precision. With the above-described configuration, the outer circumference surface of the end portion of the space maintaining member 103 at the electrical resistance adjustment layer 104 side is prevented from contacting the image carrier 61 and a generation of a leak current due to contact of the adjacent electrical resistance adjustment layer 104 and the image carrier 61 via the end portion of the space maintaining member 103 can be prevented. In addition, by making the end portion of the space maintaining member 103 at the electrical resistance adjustment layer 104 side lower, a clearance (i.e. clearance processing) is obtained for a cutting blade when implementing removal processes. It is to be noted that the shape of the clearance can be any shape as long as the outer circumference surface of the end portion of the space maintaining member 103 does not contact the image carrier 61.

When coating the surface layer 105 on the electrical resistance adjustment layer 104, implementing masking at the borderline between the electrical resistance adjustment layer 104 and the space maintaining member 103 is difficult to control when considering variation in formation. By forming a difference in height and forming the surface layer 105 to the space maintaining member 103 formed to the same height as the electrical resistance adjustment layer 104 or lower, the surface layer 105 is reliably formed on all portions of the electrical resistance adjustment layer 104.

The properties needed for the space maintaining member 103 are stably forming the minute space G between the charging member 101 and the image carrier 61 in an environment and over a long period of time. To obtain the properties, it is preferable that a material forming the space maintaining member 103 has low moisture absorption and small abrasion resistance. In addition, a property of less likely adhesion of the toner and the toner additives is important, and not wearing out the image carrier 61 due to the sliding friction when the space maintaining member 103 contacts the image carrier 61 is important. According to various conditions, the material is appropriately selected. Specific examples include, but are not limited to, polyethylene (PE), polypropylene (PP), polyacetal (POM), polymethylmethacrylate (PMMA), polystyrene (PS), a copolymer (e.g., acrylonitrile styrene copolymer (AS), acrylonitrile butadiene styrene copolymer (ABS)), polycarbonate (PC), urethane resin, and fluorine resin (e.g., polytetrafluoroethylene (PTFE)).

To reliably fix the space maintaining member 103, an adhesive is applied to fix. It is preferable that the space maintaining member 103 is formed of an insulating material and has a volume specific resistance of approximately $10^{13}$ Ωcm or more. The reason for the insulating material is to eliminate the generation of the leak current with the image carrier 61. The space maintaining member 103 is easily formed with forming processes.

To obtain a conductive mechanism with ion conductivity, the configuration of the electrical resistance adjustment layer 104 is as follows. The electrical resistance adjustment layer 104 is formed of a resin composition including a thermoplastic polymer having an ether group as a component of a resin matrix, and at least a polyketone fiber and an electrolytic salt dispersed within the resin matrix. The reason for the need of ion conductivity is as follows. In a case in which commonly used carbon black is employed as a conductive agent for electronic conductivity, a charge is discharged to the image carrier 61 via the conductive agent for electronic conductivity. Accordingly, minute discharge unevenness may be generated caused by the state of dispersion of the conductive agent for electronic conductivity. As a result, high image quality is difficult to obtain. The minute discharge unevenness phenomenon is particularly notable when high voltage is applied.

An example of an ion conductive material is salts with low molecular weight such as alkali metal salt and ammonium salt. However, the aforementioned examples of the ion conductive material become polarized with the passage of electric current and become easy to bleed out. Therefore, the thermoplastic polymer including the ether group is employed as a polymer ion conductive material.

By including the ether group in a polymer molecule, the above-described salts with low molecular weight are stabilized by an oxygen atom in an ether bond and low resistance value is obtained. The ion conductive material configured from salts with low molecular weight in the resin matrix is dispersed uniformly at a molecule level and fixed. Therefore, uneven resistance value accompanying poor dispersion as seen in a composition dispersed with carbon black as the conductive agent for electronic conductivity can be prevented. In addition, due to being a polymer material, bleeding out is unlikely to occur. An example of the thermoplastic polymer including the ether group is polyether ester amide. The thermoplastic polymer including the ether group is generally broadly divided in hydrophilicity and hydrophobicity grades according to the ratio of the ether group in the thermoplastic polymer. Thus, properties differ greatly. Multiple differing polymer grades can be blended to obtain a desired property.

However, in the conductive mechanism with ion conductivity, a reaction with a hydrogen ion and a hydroxide ion in the atmosphere plays a part in a conduction path. Conductivity is obtained by a material itself absorbing water and thus, the influence of the amount of water in the air to conductivity is extremely high. The polymer ion conductive material generally has a high water absorbability and volume change (i.e., swelling) due to water absorption is large. Therefore, in a case in which the polymer ion conductive material is employed as the material of the electrical resistance adjustment layer 104 in a proximity charging method, the change of the minute space G in between the charging member 101 and the image carrier 61 due to the environment is large and charging properties decline.

More specifically, under high temperature and high humidity environments, the electrical resistance adjustment layer 104 swells and the minute space G between the charging member 101 and the image carrier 61 declines. In extreme cases, the charging member 101 and the image carrier 61 contacts each other. Using the electrical resistance adjustment layer 104 under high temperature and high humidity environments over time results in the adherence of discharge products on the image carrier 61 to the charging member 101 side, and conductivity at sections to which the discharge products adhere to decline and image defects such as black streaks occur. In addition, under low temperature and low humidity environments, the space becomes large and discharge from the charging member 101 to the image carrier 61 becomes non-uniform. When an analog halftone image is output, white dots (i.e., small white spots) occur leading to image defects. To reduce swelling of the charging member 101, it is necessary to change mixing formulation of the electrical resistance adjustment layer 104 to obtain low water absorption properties. More specifically, by reducing the ratio of the ether group contributing to water absorbability, water absorption properties of the resin composition can be reduced. However, at the same time, resistance increase occurs and necessary conductivity for the charging member 101 cannot be obtained. Due to water absorption properties and conductivity being in a relation of a tradeoff, so far, balancing reduction in water absorption properties and increasing conductivity is difficult.

Accordingly, as a result of considering formulation of the electric resistance adjustment layer 104, the present inventors found a balance of low resistance and reduced water absorption property with the above-described resin composition. More specifically, the resin composition is, as described above, configured of the thermoplastic polymer having the ether group as the resin matrix, and at least the polyketone fiber and the electrolytic salt is dispersed within the resin matrix.

Normally, when a thermoplastic resin with insulation properties is mixed to the thermoplastic polymer having the ether group, water absorption can be reduced but, at the same time, resistance increase occurs and conductivity declines. In contrast, in a context of having same insulation properties, by mixing an insoluble polyketone fiber when forming the thermoplastic polymer having the ether group, increase in resistance value does not occur.

The polyketone fiber is insoluble with respect to the resin matrix at formation and forms a mesh structure in an extremely stable state within the resin matrix. The reason for no decline in conductivity is thought to be due to the establishment of prioritized conduction paths along the mesh structure.

When the mixing of the polyketone fiber is compared to a case of mixing a fiber formed of a polymer having an aromatic skeleton that is also insoluble with respect to the resin matrix at formation, the mixing of the polyketone fiber obtains further low resistance. The reason for further low resistance is thought to be due to dispersion of the polyketone fiber being denser.

In addition, the generation of variation in processing accuracy seen in a case of mixing a fiber formed of a polymer having an aromatic skeleton is significantly suppressed by mixing the polyketone fiber.

By mixing the polyketone fiber, balance of reduced water absorption properties and increased conductivity is obtained and also good processability is obtained. Furthermore, in contrast to the fiber formed of a polymer having an aromatic skeleton that is expensive, the polyketone fiber is comparatively inexpensive and reduction in product cost is obtained. In addition, affinity in a combination of polyether ester amide and the polyketone fiber is significant and further low resistance can be obtained.

Figure 6:
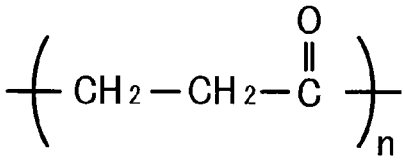
FIG. 6 is a diagram illustrating a configuration of a polymer constituting a polyketone fiber.

The polyketone fiber is configured of polyketone having approximately 95% by weight to 100% by weight of repeating unit poly 1-oxotrimethylene shown in FIG. 6. The polyketone fiber is called a super fiber with good properties in all aspects including high strength, high elastic modulus, and high heat resistance. The polyketone fiber can be obtained from Asahi Kasei Fibers Corporation, CYBERLON series.

It is preferable that the length of the polyketone fiber is approximately 0.1 mm or more to less than 5 mm, more preferably approximately 0.2 mm or more to less than 2 mm. If the length of the polyketone fiber is too short, increased conductivity may not be expressed. If the length of the polyketone fiber is too long, the fibers may become entangled with each other and not disperse uniformly.

In addition, it is preferable that a thickness of the polyketone fiber in dtex, mass in grams per 1000 m, is approximately 0.01 or more to less than 100, more preferably approximately 10 or more to less than 100. If the thickness of the polyketone fiber is too thin, conductivity may not increase. If the thickness of the polyketone fiber is too thick, processability declines and surface smoothness may not be obtained.

A mixing ratio of the polyketone fiber is preferably approximately 0.01% by weight or more to less than 30% by weight with respect to the whole resin composition. If the mixing amount of the polyketone fiber is too small, water absorption properties and conductivity may be insufficient. If the mixing amount of the polyketone fiber is too large, uniform dispersion in the resin composition is difficult. A more preferable mixing ratio is a range of approximately 0.1% by weight or more to less than 5% by weight with respect to the whole resin composition.

In the present embodiment, it is difficult to obtain conductivity for use as the charging member 101 only with the thermoplastic polymer having the ether group and the polyketone fiber. By combining the electrolytic salt, conductivity increase appropriate for use in the charging member 101 is obtained.

An example of the electrolytic salt is perchlorates and organic anion salts containing fluorine. The electrolytic salt is highly conductive and has relatively low water absorption properties, and thus balancing reduction in water absorption properties and conductivity increase is possible.

More specifically, perchlorates may be any commonly used perchlorates though when considering conductivity, it is preferable that perchlorates are alkali metal salt or one type or more of salt selected from alkaline earth metal salt. More preferably, perchlorates are lithium perchlorate and sodium perchlorate exhibiting a high degree of dissociation, and increase in the amount of ion dissociation significantly increases conductivity.

In addition, as a result of considering the electrolytic salt to obtain low resistance, further low resistance can be obtained by adding both perchlorates and organic anion salts containing fluorine. When both perchlorates and organic anion salts containing fluorine are added and dispersed in a polymer composition, perchlorates and organic anion salts containing fluorine do not impede the conduction path of each other. When compared to adding singly perchlorates or adding singly organic anion salts containing fluorine, even if the total mixing amount of salt is the same, the combined addition of different types of the electrolytic salt obtains higher conductivity synergistically. If different types of the electrolytic salt are combined, further low resistance is obtained even if the amount of addition is small.

It is preferable that organic anion salts containing fluorine are salts including a negative ion having a fluoro group and a sulfonyl group. Salts including the negative ion having the fluoro group and the sulfonyl group delocalizes the charge due to the strong electron-withdrawing effect of the fluoro group (—F) and the sulfonyl group (—$SO_2$—). As a result, the negative ion exhibits a high degree of dissociation even if inside the stable polymer composition and high ion conductivity can be obtained. Preferred examples exhibiting significant reduction of the resistance value are alkali metal salt of bis(fluoroalkylsulfonyl)imide, alkali metal salt of tris(fluoroalkylsulfonyl)methide, and alkali metal salt of fluoroalkyl sulfonic acid. Specific examples of salts include, but are not limited to, bis(trifruoromethanesulfonyl)imide lithium ($Li(CF_3SO_2)_2N$), bis(trifluoromethanesulfonyl)imide potassium ($K(CF_3SO_2)_2N$), bis(trifluoromethanesulfonyl)imide sodium ($Na(CF_3SO_2)_2N$), tris(trifluoromethanesulfonyl)methide lithium ($Li(CF_3SO_2)_3C$), tris(trifluoromethanesulfonyl)methide potassium ($K(CF_3SO_2)_3C$), tris(trifluoromethanesulfonyl)methide sodium ($Na(CF_3SO_2)_3C$), lithium trifluoromethanesulfonate ($Li(CF_3SO_3)$), potassium trifluoromethanesulfonate ($K(CF_3SO_3)$), and sodium trifluoromethanesulfonate ($Na(CF_3SO_3)$). Among the specific examples, employing lithium salts of lithium trifluoromethanesulfonate, bis(trifruoromethanesulfonyl)imide lithium, and tris(trifluoromethanesulfonyl)methide lithium with high conductivity is preferable.

The perchlorates and organic anion salts containing fluorine can be mixed to a predetermined ratio by adding and mixing to the polymer ion conductive material. In addition, one type or more of each electrolytic salt can be blended and mixed in the polymer ion conductive material. An example of the polymer ion conductive material having perchlorates is IRGASTAT P18FCA from BASF Japan Ltd. An example of the polymer ion conductive material having organic anion salts containing fluorine is SANKONOL series from Sanko Chemical Industry Co. Ltd.

It is preferable that the mixing amount of salt in the polymer ion conductive material is approximately 0.01% by weight or more to less than 20% by weight. More preferably, the range of the mixing amount of salt in the polymer ion conductive material is approximately 0.1% by weight or more to less than 10% by weight.

If the mixing amount of salt is too small, the increase in conductivity induced by mixing salt may be insufficient. If the mixing amount of salt is too large, uniform dispersion in the resin composition is difficult. It is preferable that the volume specific resistance of the electrical resistance adjustment layer 104 is in a range from approximately $10^6$ Ωcm or more to less than $10^9$ Ωcm. More preferably, the volume specific resistance of the electrical resistance adjustment layer 104 is in a range from approximately $10^6$ Ωcm or more to less than $10^8$ Ωcm. If the volume specific resistance of the electrical resistance adjustment layer 104 is too high, charging capability or transfer capability may be insufficient. If the volume specific resistance of the electrical resistance adjustment layer 104 is too low, leak generated by voltage concentration to the whole image carrier 61 may occur. As a result, good images may be difficult to obtain.

The conductive member employed in an embodiment of the present invention needs to be machine processed such as by cutting and grinding to obtain component high precision. The polyether ester amide serving as the thermoplastic polymer having the ether group is soft and has a problem of being difficult to machine process. Thus, according to need, blending a different thermoplastic resin having higher hardness than employed thermoplastic resins resolves the above problem. By increasing hardness, machine processability improves. Preferably, the thermoplastic resins having higher hardness are, but not limited to, general-purpose resins or engineering plastics. Applying forming processes to general-purpose resins or engineering plastics is easy. Specific examples of general-purpose resins include, but are not limited to, polyethylene (PE), polypropylene (PP), polymethylmethacrylate (PMMA), polystyrene (PS), and copolymers (e.g., AS, ABS). Specific examples of engineering plastics include, but are not limited to, polycarbonates and polyacetals.

As long as the mixing amount of the thermoplastic resin having higher hardness is within a range that does not impair conductivity of the electrical resistance adjustment layer 104, the mixing amount can be set according to the needs of machine processing. In a case in which the polyketone fiber is combined, conductivity increase and reduction in water absorption better than the thermoplastic polymer having the ether group or the thermoplastic polymer having the ether group mixed with the thermoplastic resin having higher hardness is possible.

When blending two or more thermoplastic resins, high conductivity may not be obtained due to compatibility between the two thermoplastic resins being unfavorable. When compatibility between the two thermoplastic resins is unfavorable, adding a compatibility agent is preferable. The compatibility agent is employed for increasing compatibility and operates between the two thermoplastic resins. An example of the compatibility agent is the above-described thermoplastic polymer having the ether group and a graft copolymer having affinity to both the above-described thermoplastic polymer having the ether group and the thermoplastic resin having higher hardness.

The graft copolymer is preferably a graft copolymer having a polycarbonate resin as a main chain and includes an acrylonitrile/styrene/glycidyl methacrylate copolymer. Due to the main chain of the polycarbonate resin having a molecular structure including a polar group and a dioxy group chain, the inter-molecular attractive force is strong. Therefore, mechanical strength and creep properties are excellent. Particularly, impact strength is significantly superior compared to other plastics. The acrylonitrile/styrene/glycidyl methacrylate copolymer is formed from an acrylonitrile component, a styrene component, and a glycidyl methacrylate component serving as a reactive group. Due to the application of heat when melting and kneading the components, the glycidyl methacrylate component serving as the reactive group is tightly bound chemically to the thermoplastic polymer having the ether group by an epoxy group reacting with an ester group or an amide group of the polyether ester amide serving as the thermoplastic polymer having the ether group. Furthermore, when a thermoplastic resin having higher hardness including the same functional group such as ABS resin is employed, the acrylonitrile component and the styrene component obtain good compatibility. Accordingly, the graft copolymer including the acrylonitrile/styrene/glycidyl methacrylate copolymer functions as the compatibility agent between the thermoplastic polymer having the ether group and the thermoplastic resin having higher hardness that normally exhibit low affinity. As a result, the dispersion state of the thermoplastic polymer having the ether group and the thermoplastic resin having higher hardness is uniform and is denser, and high conductivity is obtained. In addition, the graft copolymer itself has low water absorption properties and volume change accompanying water absorption is small. Furthermore, a surface area of the surface of the thermoplastic polymer having the ether group contacting the air is reduced due to the densification of the dispersion state, and low water absorption is obtained. As a result, in a formulation of mixing the polyketone fiber and the graft copolymer including the acrylonitrile/styrene/glycidyl methacrylate copolymer, further increase in conductivity and further reduction in water absorbability is possible. The amount of the graft copolymer is preferably set to approximately 1% by weight or more to less than 15% by weight with respect to a total (i.e., 100% by weight) of the thermoplastic polymer having the ether group and the thermoplastic resin having higher hardness. More preferably, the mixing amount of graft copolymer is approximately 1% by weight or more to less than 5% by weight. By adding the graft copolymer in the preferable range, the compatibility of the thermoplastic polymer having the ether group and the thermoplastic resin having higher hardness is increased and excellent machine processing stability is obtained.

Regarding manufacturing method of the resin composition to form the electrical resistance adjustment layer 104, there is no particular limitation. A mixture of each material can be easily manufactured by melting and kneading with a twin screw kneader or a kneader. The forming of the electrical resistance adjustment layer 104 on the conductive supporting body 106 can be easily implemented by a mechanism for extrusion molding or injection molding to coat an above-described semi-conductive resin composition on the conductive supporting body 106.

In a case in which the conductive member is configured of only the electrical resistance adjustment layer 104 on the conductive supporting body 106 and is employed as the charging member 101, the toner and the toner additives may adhere to the electrical resistance adjustment layer 104 resulting in decline in performance. By forming the surface layer 105 on the electrical resistance adjustment layer 104, the decline in performance due to the adherence of the toner and the toner additives is prevented.

The resistance value of the surface layer 105 is formed to be larger than the electrical resistance adjustment layer 104. As a result, voltage concentration to defective portions of the image carrier 61 and abnormal discharge (i.e., leaks) are avoided. However, if the resistance value of the surface layer 105 is too high, charging capability or transfer capability may be insufficient. Therefore, it is preferable that the difference in resistance value between the surface layer 105 and the electrical resistance adjustment layer 104 is approximately less than $10^3$ Ωcm.

Preferably, materials for forming the surface layer 105 are materials with excellent non-adhesion properties such as fluorine-based resins, silicone-based resins, polyamide resins, and polyester resins resulting in a high toner fixation prevention. The forming of the surface layer 105 on the electrical resistance adjustment layer 104 is implemented by melting the above-described surface layer 105 constituting material with an organic solvent and making a coating, and coating with various coating methods such as spray coating, dipping, and roll coating. It is preferable that the thickness of the surface layer 105 is approximately 10 μm or more to less than 30 μm. More preferably, the thickness of the surface layer 105 is in a range from approximately 10 μm or more to less than 20 μm. If the thickness is too thin, uniform thickness is difficult to obtain. If the thickness is too thick, surface smoothness deteriorates.

Both a one-package type coating and a two-package type coating may be employed for the surface layer 105 forming coating. However, by employing the two-package type coating in which a curing agent is used in combination, increased environment resistance properties, non-adhesion properties, and release properties is obtained. In a case when the two-package type coating is employed, the general method for cross-linking and hardening a formed coat is applying heat. However, due to the electrical resistance adjustment layer 104 being configured of thermoplastic resin, application of high temperature heat is not possible. Therefore, it is preferable that the two-package type coating is a coating including a main agent having a hydroxyl group within a molecule and an isocyanate resin that cross-links with the hydroxyl group. More specifically, by employing the isocyanate resin, cross-linking and hardening reaction can be implemented at a comparatively low temperature of less than approximately 100° C.

As a result of considering toner non-adhesiveness, a silicone resin is found to be a resin with high toner non-adhesiveness. Among silicone resins, particularly, an acrylic silicone resin having an acrylic skeleton within a molecule exhibits good toner non-adhesiveness.

In a case in which the conductive member is employed as the charging member of the image forming apparatus, electrical properties (i.e., resistance value) is important and imparting conductivity to the surface layer 105 is necessary. A method for imparting conductivity is dispersing a conductivity imparting material within a resin material. Specific examples of conductivity imparting materials include, but are not limited to, conductive carbons (e.g., ketjen black EC and acetylene black), carbons for rubber (e.g., super abrasion furnace (SAF), intermediate SAF (ISAF), high abrasion furnace (HAF), fast extruding furnace (FEF), general purpose furnace (GPF), semi-reinforcing furnace (SRF), fine thermal (FT), medium thermal (MT)), carbons for color with oxidation treatment, pyrolytic carbons, metals and metal oxides (e.g., indium tin oxide (ITO), tin oxide, titanium oxide, zinc oxide, copper, silver, germanium), polyanilines, polypyrroles, polyacetylenes, and a combination of two or more of the above-described specific examples.

In addition, an ion conductive material can be employed as the conductivity imparting material. Specific examples of inorganic ion conductive materials include, but are not limited to, sodium perchlorate, lithium perchlorate, calcium perchlorate, and lithium chloride.

Further, specific examples of organic ion conductive materials include, but are not limited to, quaternary phosphonium salts (e.g., ethyl triphenyl phosphonium tetrafluoroborate, tetraphenyl phosphonium bromide), denatured fatty acid dimethyl ammonium ethosulfate, ammonium acetate stearate, and lauryl ammonium acetate.

In view of the foregoing, the resin composition of the present invention has a configuration including at least the thermoplastic resin having the ether group as a component of the resin matrix, and at least the polyketone fiber and the electrolytic salt dispersed within the resin matrix. With the configuration, high surface precision with cutting processes and grinding processes is stably obtained without precision variation. In addition, low resistance of the electrical resistance adjustment layer and reduction in water absorption is obtained. Accordingly, when the resin composition is employed as the charging member forming the minute space between the charging member and the image carrier of the image forming apparatus, the change of the minute space due to environmental variation can be reduced which in turn leads to preventing the generation of image failure caused by the change of the minute space due to environmental variation.

Having generally described preferred embodiments of the present invention, it is to be noted that the conductive member of the present invention is not limited to the above-described configuration of the preferred embodiments.

Additional modifications and variations of the conductive member of the present invention are possible in light of the above teachings. It is therefore to be understood that within the scope of the appended claims the invention may be practiced other than as specifically described herein.

Further understanding can be obtained by reference to specific examples, which are provided hereinafter.

Example 1

A resin composition (volume specific resistance: $2\times10^8$ Ωcm) of materials indicated in the following formulation 1, mixed at a mixing ratio indicated in formulation 1, melted and kneaded at 220° C. is coated on an outer circumference surface middle portion of a stainless core shaft (outer diameter 10 mm) with injection molding to form an electrical resistance adjustment layer. A to E in the following formulations represent the following materials. "A" is a thermoplastic polymer having an ether group. "B" is a polyketone fiber. "C" is an electrolytic salt. "D" is a thermoplastic resin having higher hardness than the thermoplastic polymer having the ether group. "E" is a graft copolymer having affinity to both the thermoplastic polymer having the ether group and the thermoplastic resin having higher hardness.

TABLE 1

| <Formulation 1> | |
|---|---|
| A: IRGASTAT P18FCA (polyether ester amide (containing sodium perchlorate 3% by weight) from BASF Japan Ltd.) | 55 parts by weight |
| B: Polyketone fiber (CYBERLON 80 dtex, cut into 1 mm lengths, from Asahi Kasei Fibers Corporation) | 5 parts by weight |
| D: ABS resin (DENKA ABS GR-3000 from Denki Kagaku Kogyo Kabushiki Kaisha) | 40 parts by weight |
| With respect to 100 parts by weight of a mixture of A, B, and D, | |
| E: Polycarbonate/glycidylmethacrylate/styrene/acrylonitrile copolymer (MODIPER C L430-G from NOF Corporation) | 4.5 parts by weight |
| C: Lithium trifluoromethanesulfonate (LiTFS, organic anion salt containing fluorine from Morita Chemical Industries Co., Ltd.) | 2 parts by weight |

Subsequent processes are insertion of a space maintaining member, shaping, forming a surface layer, and heat processing.

More specifically, inserting a ring shaped space maintaining member made of high density polyethylene resin (NOVATEC HD HY 540 from Japan Polyethylene Corporation) at both ends of the electrical resistance adjustment layer, and fixing to the core shaft and the electrical resistance adjustment layer with adhesive. The length of the electrical resistance adjustment layer is 2 mm.

Next, the outer diameter (maximum outer diameter) of the space maintaining member is finished to 12.12 mm and the outer diameter of the electrical resistance adjustment layer is finished to 12.00 mm with cutting processes simultaneously.

Next, a surface layer forming coating configured as follows is coated on the surface of the electrical resistance adjustment layer with spray coating. A heating process is applied for 90 minutes at 105° C. Accordingly, the conductive member (i.e., charging member of the image forming apparatus) is obtained. The thickness of the surface layer is approximately 10 μm and the surface resistance is $2\times10^9$ Ωcm.

TABLE 2

| <Surface layer forming coating> | |
|---|---|
| Acrylic silicone resin (3000VH-P, solid content 38%, from Kawakami Paint MFG. Co., Ltd.) | 100 g |
| Polyether polyol resin (EXCENOL E540, ethylene oxide amount 40% by weight, solid content 100%, from Asahi Glass Co., Ltd.) | 96 g |
| Isocyanate resin (T4 curing agent, solid content 70%, from Kawakami Paint MFG. Co., Ltd.) | 58 g |
| Organic salt catalyst (U-CAT SA1, solid content 100%, 0.9 g bis(trifluoromethane)sulfonyl imide acid lithium butyl acetate dissolving liquid (solid content 20%), from Sanko Chemical Industry Co., Ltd.) | 50 g |
| Carbon dispersion liquid (REC-SM-23, solid content 25%, from Resino Color Industry Co., Ltd.) | 3.7 g |

The above-described coating constituents are diluted with butyl acetate 320 g and methyl ethyl ketone (MEK) 36 g, and a surface layer forming coating is obtained.

Example 2

A resin composition (volume specific resistance: $2\times10^9$ Ωcm) of materials indicated in the following formulation 2, mixed at a mixing ratio indicated in formulation 2, melted and kneaded at 220° C. is coated on an outer circumference surface middle portion of a stainless core shaft (outer diameter 8 mm) with injection molding to form an electrical resistance adjustment layer.

TABLE 3

| <Formulation 2> | |
|---|---|
| A: TPAE-10HP (polyether ester amide from T&K TOKA Corporation) | 50 parts by weight |
| B: Polyketone fiber (CYBERLON 90 dtex, cut into 0.5 mm lengths, from Asahi Kasei Fibers Corporation) | 10 parts by weight |
| D: ABS resin (DENKA ABS GR-0500 from Denki Kagaku Kogyo Kabushiki Kaisha) | 40 parts by weight |
| With respect to 100 parts by weight of a mixture of A, B, and D, | |
| E: Polycarbonate/glycidylmethacrylate/styrene/acrylonitrile copolymer (MODIPER C L430-G from NOF Corporation) (Graft copolymer) | 4.5 parts by weight |
| C: Lithium trifluoromethanesulfonate (LiTFS, organic anion salt containing fluorine from Morita Chemical Industries Co., Ltd.) | 3 parts by weight |

Subsequent processes are the same as formulation 1, and accordingly, the conductive member (i.e., charging member of the image forming apparatus) is obtained.

Example 3

A resin composition (volume specific resistance: $3\times10^8$ Ωcm) of materials indicated in the following formulation 3, mixed at a mixing ratio indicated in formulation 3, melted and kneaded at 230° C. is coated on an outer circumference surface middle portion of a stainless core shaft (outer diameter 8 mm) with injection molding to form an electrical resistance adjustment layer.

TABLE 4

| <Formulation 3> | |
|---|---|
| A: SANKONOL TBX-65 (polyether ester amide (containing lithium trifluoromethanesulfonate 3% by weight) from Sanko Chemical Industry Co. Ltd.) | 60 parts by weight |
| B: Polyketone fiber (CYBERLON 100 dtex, cut into 2 mm lengths, from Asahi Kasei Fibers Corporation) | 10 parts by weight |
| D: Polycarbonate resin (IUPILON H-4000 from Mitsubishi Engineering-Plastics Corporation) | 30 parts by weight |
| With respect to 100 parts by weight of a mixture of A, B, and D, | |
| E: Polycarbonate/glycidylmethacrylate/styrene/acrylonitrile copolymer (MODIPER C L430-G from NOF Corporation) | 4.5 parts by weight |
| C: Lithium perchlorate (perchlorates from Mitsuwa Chemicals Co., Ltd.) | 3 parts by weight |

Subsequent processes are the same as formulation 1, and accordingly, the conductive member (i.e., charging member of the image forming apparatus) is obtained.

Example 4

A resin composition (volume specific resistance: $4\times10^8$ Ωcm) of materials indicated in the following formulation 4, mixed at a mixing ratio indicated in formulation 4, melted and kneaded at 220° C. is coated on an outer circumference surface middle portion of a stainless core shaft (outer diameter 8 mm) with injection molding to form an electrical resistance adjustment layer.

TABLE 5

| <Formulation 4> | |
|---|---|
| A: SANKONOL TBX-310 (polyolefin block polymer (a thermoplastic polymer having an ether group) (containing lithium trifluoromethanesulfonate) from Sanko Chemical Industry Co. Ltd.) | 45 parts by weight |
| B: Polyketone fiber (CYBERLON 95 dtex, cut into 3 mm lengths, from Asahi Kasei Fibers Corporation) | 5 parts by weight |
| D: ABS resin (DENKA ABS GR-0500 from Denki Kagaku Kogyo Kabushiki Kaisha) | 50 parts by weight |
| With respect to 100 parts by weight of a mixture of A, B, and D, | |
| E: Polycarbonate/glycidylmethacrylate/styrene/acrylonitrile copolymer (MODIPER C L430-G from NOF Corporation) | 9 parts by weight |
| C: Lithium perchlorate (perchlorates from Mitsuwa Chemicals Co., Ltd.) | 1 part by weight |

Subsequent processes are the same as formulation 1, and accordingly, the conductive member (i.e., charging member of the image forming apparatus) is obtained.

Example 5

A resin composition (volume specific resistance: $3\times10^8$ Ωcm) of materials indicated in the following formulation 5, mixed at a mixing ratio indicated in formulation 5, melted and kneaded at 220° C. is coated on an outer circumference surface middle portion of a stainless core shaft (outer diameter 8 mm) with injection molding to form an electrical resistance adjustment layer.

TABLE 6

| <Formulation 5> | |
|---|---|
| A: PEBAX MV1041 (polyether ester amide from Arkema K.K.) | 50 parts by weight |
| B: Polyketone fiber (CYBERLON 85 dtex, cut into 0.3 mm lengths, from Asahi Kasei Fibers Corporation) | 10 parts by weight |
| D: HI-PS resin (H450 from Toyo-Styrene Co., Ltd.) | 40 parts by weight |
| With respect to 100 parts by weight of a mixture of A, B, and D, | |
| E: Polycarbonate/glycidylmethacrylate/styrene/acrylonitrile copolymer (MODIPER C L430-G from NOF Corporation) | 4.5 parts by weight |
| C: Lithium perchlorate (perchlorates from Mitsuwa Chemicals Co., Ltd.) | 3 parts by weight |
| bis(pentafluoroethanesulfonyl) imide lithium (LiBETI, organic anion salt containing fluorine from Kishida Chemical Co., Ltd.) | 1 part by weight |

Subsequent processes are the same as formulation 1, and accordingly, the conductive member (i.e., charging member of the image forming apparatus) is obtained.

Comparative Example 1

A resin composition of materials indicated in the following formulation 6, mixed at a mixing ratio indicated in formulation 6, without melting and kneading is coated on an outer circumference surface middle portion of a stainless core shaft (outer diameter 8 mm) with injection molding to form an electrical resistance adjustment layer.

TABLE 7

| <Formulation 6> | |
|---|---|
| A: IRGASTAT P18FCA (polyether ester amide (containing perchlorates 3% by weight) from BASF Japan Ltd.) | 60 parts by weight |
| B: Polyamide fiber (TORAY NYLON6 1.7 dtex, 1 mm length, from Toray Industries Inc.) | 10 parts by weight |
| D: ABS resin (DENKA ABS GR-0500 from Denki Kagaku Kogyo Kabushiki Kaisha) | 30 parts by weight |

Subsequent processes are the same as formulation 1, and accordingly, the conductive member (i.e., charging member of the image forming apparatus) is obtained.

Comparative Example 2

A resin composition of materials indicated in the following formulation 7, mixed at a mixing ratio indicated in formulation 7, without melting and kneading is coated on an outer circumference surface middle portion of a stainless core shaft (outer diameter 8 mm) with injection molding to form an electrical resistance adjustment layer.

TABLE 8

| <Formulation 7> | |
|---|---|
| A: PEBAX 5533 (polyether ester amide from Arkema K.K.) | 40 parts by weight |
| B': Nylon fiber (TORAY NYLON 66 1.7 dtex, 1 mm length, from Toray Industries Inc.) (B' is defined as a fiber other than polyketone fiber) | 10 parts by weight |
| D: Polycarbonate resin (PANLITE L-1225L from Tejin Chemicals Ltd.) | 50 parts by weight |
| With respect to 100 parts by weight of a mixture of A, B, and D, | |

TABLE 8-continued

| <Formulation 7> | |
|---|---|
| C: Organic phosphonium salt (HISHICOLIN ETPP-1, organic phosphonium salts from Nippon Chemical Industries Co., Ltd.) | 3 parts by weight |

Subsequent processes are the same as formulation 1, and accordingly, the conductive member (i.e., charging member of the image forming apparatus) is obtained.

Comparative Example 3

A resin composition of materials indicated in the following formulation 8, mixed at a mixing ratio indicated in formulation 8, without melting and kneading is coated on an outer circumference surface middle portion of a stainless core shaft (outer diameter 8 mm) with injection molding to form an electrical resistance adjustment layer.

TABLE 9

| <Formulation 8> | |
|---|---|
| A: Polyether ester amide (PELESTAT 300 from Sanyo Chemical Industries, Ltd.) | 50 parts by weight |
| B': Polyvinyl alcohol fiber (VINYLON SMR 1.1 dtex, 1 mm length, from Unitika Ltd.) | 10 parts by weight |
| D: Polypropylene resin (NOVATEC-PP MA3 from Japan Polypropylene Corporation) | 40 parts by weight |
| With respect to 100 parts by weight of a mixture of A, B, and D, | |
| C: Lithium perchlorate (perchlorates from Mitsuwa Chemicals Co., Ltd.) | 2 parts by weight |
| Lithium trifluoromethanesulfonate (LiTFS, organic anion salt containing fluorine from Morita Chemical Industries Co., Ltd.) | 3 parts by weight |

Subsequent processes are the same as formulation 1, and accordingly, the conductive member (i.e., charging member of the image forming apparatus) is obtained.

Comparative Example 4

A resin composition of materials indicated in the following formulation 9, mixed at a mixing ratio indicated in formulation 9, without melting and kneading is coated on an outer circumference surface middle portion of a stainless core shaft (outer diameter 8 mm) with injection molding to form an electrical resistance adjustment layer.

TABLE 10

| <Formulation 9> | |
|---|---|
| A: Polyether ester amide (PELESTAT NC6321 from Sanyo Chemical Industries, Ltd.) | 70 parts by weight |
| B': Polypropylene fiber (PYLEN 1.7 dtex, 1 mm length, from Mitsubishi Rayon Co., Ltd.) | 10 parts by weight |
| D: Polyethylene resin (NOVATEC HD HJ360 from Japan Polyethylene Corporation) | 20 parts by weight |
| With respect to 100 parts by weight of a mixture of A, B, and D, | |
| C: Lithium trifluoromethanesulfonate (LiTFS, organic anion salt containing fluorine from Morita Chemical Industries Co., Ltd.) | 3 parts by weight |

Subsequent processes are the same as formulation 1, and accordingly, the conductive member (i.e., charging member of the image forming apparatus) is obtained.

Comparative Example 5

A resin composition of materials indicated in the following formulation 10, mixed at a mixing ratio indicated in formulation 10, without melting and kneading is coated on an outer circumference surface middle portion of a stainless core shaft (outer diameter 10 mm) with injection molding to form an electrical resistance adjustment layer.

TABLE 11

| <Formulation 10> | |
|---|---|
| A: TPAE-H461 (polyether ester amide from T&K TOKA Corporation) | 55 parts by weight |
| B: meta-aramid fiber (CORNEX 2.2 dtex, 1 mm length, from Teijin Technoprocucts) | 5 parts by weight |
| D: Polyproplene resin (NOVATEC-PP MA3 from Japan Polypropylene Corporation) | 40 parts by weight |
| With respect to 100 parts by weight of a mixture of A, B, and D, | |
| C: Lithium perchlorate (perchlorates from Mitsuwa Chemicals Co., Ltd.) | 2 parts by weight |

Subsequent processes are the same as formulation 1, and accordingly, the conductive member (i.e., charging member of the image forming apparatus) is obtained.

Comparative Example 6

A resin composition of materials indicated in the following formulation 11, mixed at a mixing ratio indicated in formulation 11, without melting and kneading is coated on an outer circumference surface middle portion of a stainless core shaft (outer diameter 10 mm) with injection molding to form an electrical resistance adjustment layer.

TABLE 12

| <Formulation 11> | |
|---|---|
| A: Polyether ester amide (PELESTAT NC6321 from Sanyo Chemical Industries, Ltd.) | 55 parts by weight |
| B: Polyarylate fiber (VECTRAN 2.8 dtex, 1 mm length, from Kuraray Co., Ltd.) | 5 parts by weight |
| D: Polycarbonate resin (IUPILON S-2000 from Mitsubishi Engineering-Plastics Corporation) | 40 parts by weight |
| With respect to 100 parts by weight of a mixture of A, B, and D, | |
| C: Lithium trifluoromethanesulfonate (LiTFS, organic anion salt containing fluorine from Morita Chemical Industries Co., Ltd.) | 3 parts by weight |

Subsequent processes are the same as formulation 1, and accordingly, the conductive member (i.e., charging member of the image forming apparatus) is obtained.

Comparative Example 7

A resin composition of materials indicated in the following formulation 12, mixed at a mixing ratio indicated in formulation 12, without melting and kneading is coated on an outer circumference surface middle portion of a stainless core shaft (outer diameter 10 mm) with injection molding to form an electrical resistance adjustment layer.

TABLE 13

| <Formulation 12> | |
|---|---|
| A: PEBAX 5533 (polyether ester amide from Arkema K.K.) | 70 parts by weight |

TABLE 13-continued

| <Formulation 12> | |
|---|---|
| B: Poly-p-phenylene benzoxazole (PBO) fiber (ZYLON AS 2.2 dtex, 5 mm length, from Toyobo Co., Ltd.) | 5 parts by weight |
| D: Polyethylene resin (NOVATEC LL UJ480 from Japan Polyethylene Corporation) | 25 parts by weight |

Subsequent processes are the same as formulation 1, and accordingly, the conductive member (i.e., charging member of the image forming apparatus) is obtained.

Ten of each of the above-described conductive members is made and evaluated regarding processing precision when the outer diameter of the electrical resistance adjustment layer is finished to 12.00 mm with cutting processing.

More specifically, conductive members with high processing precision in which a cut surface exhibits good surface smoothness, material dispersion state exhibited at the cut surface is uniform, and processing precision variation is significantly small is evaluated as "Good" and is sufficient for use as the charging member of the image forming apparatus. Conductive members with good processing precision in which dispersion of fiber material is visible at the cut surface but exhibits small processing precision variation is evaluated as "Fair" and is sufficient for use as the charging member of the image forming apparatus. Conductive members with insufficient processing precision in which the cut surface exhibits significant unevenness due to the influence of mixed fiber material making surface smoothness bad is evaluated as "Poor" and is insufficient for use as the charging member of the image forming apparatus.

All conductive members of Examples 1 to 5 and Comparative Examples 1 to 4 exhibited results of "Good" or "Fair" necessary for use as the charging member of the image forming apparatus. However, conductive members of Comparative Examples 5 to 7 exhibited results of "Poor" and are insufficient for use as the charging member of the image forming apparatus. Accordingly, the following evaluations are not conducted for Examples 5 to 7.

The following Test 1 and Test 2 is carried out with respect to resin compositions of the above-described Examples 1 to 5 and Comparative Examples 1 to 4 employed for forming the electrical resistance adjustment layer and obtained charging members.

<Test 1>

Using the resin compositions of the above-described Examples 1 to 5 and Comparative Examples 1 to 4 employed for forming the electrical resistance adjustment layer, a circular plate test piece with a diameter of 43 mm and a thickness of 1 mm is formed. Employing a resistance measurement jig which measures by sandwiching the circular plate test piece vertically, a measurement of volume resistance at an application voltage of 100V under a reference environment (23° C., 50% Relative Humidity (RH)) is carried out. Further, water absorption rate of the circular plate test piece is measured from mass change when the circular plate test piece is placed under the reference environment (23° C., 50% RH) to adjust humidity conditions for one day and then placed under a high temperature and high humidity environment (30° C., 90% RH) for approximately one day.

Results are shown in Table 14. The circular plate test piece of the Examples, all show low levels. More specifically, volume resistance values are less than $9\times10^{10}$ Ωcm and water absorption rates are less than 3.8%. Therefore, the Examples are sufficient (i.e., evaluated as "OK") for use as the charging member of the image forming apparatus. In contrast, the circular plate test piece of the Comparative Examples, all show insufficient volume resistance values and water absorption rates. Therefore, the Comparative Examples are insufficient (i.e., evaluated as "NG") for use as the charging member of the image forming apparatus.

TABLE 14

| | Volume Resistivity 100 V (Ωcm) (23° C., 50% RH) | Water Absorption Rate (23° C., 50% RH→30° C., 90% RH 1 day) | Evaluation |
|---|---|---|---|
| Example 1 | $1.1 \times 10^{10}$ | 3.60 | OK |
| Example 2 | $6.2 \times 10^{9}$ | 3.35 | OK |
| Example 3 | $2.0 \times 10^{10}$ | 3.43 | OK |
| Example 4 | $2.1 \times 10^{9}$ | 3.60 | OK |
| Example 5 | $2.0 \times 10^{10}$ | 3.64 | OK |
| Comparative Example 1 | $3.0 \times 10^{11}$ | 3.40 | NG |
| Comparative Example 2 | $1.0 \times 10^{12}$ | 3.70 | NG |
| Comparative Example 3 | $1.0 \times 10^{11}$ | 3.90 | NG |
| Comparative Example 4 | $2.2 \times 10^{10}$ | 4.20 | NG |

<Test 2>

A charging member made from each Example 1 to 5 and each Comparative Example 1 to 4 is incorporated into the model image forming apparatus shown in FIG. 2. Continuous copying of fifty thousand sheets is conducted under a high temperature and high humidity environment (30° C., 90% RH). Evaluation of image failure due to adhesion of toner or discharge products to the surface of a charging roller configured of the charging member is carried out. The voltage applied to the charging roller is DC=−700V, AC Vpp=2.2 kV (frequency=2.2 kHz). By conducting continuous copying with the cleaning member 64*c* shown in FIG. 4 removed, accelerated evaluation is carried out.

The evaluation results are as follows. The charging roller of the Examples 1 to 5 did not generate image failure such as black streaks in copying fifty thousand sheets and good image is obtained. In contrast, the charging roller of the Comparative Examples 3 and 4 generated image failure such as black streaks in copying less than fifty thousand sheets. The charging roller of the Comparative Examples 1 and 2 exhibited an extremely high resistance and output of images is not possible.

What is claimed is:

1. A conductive member, comprising:

a conductive supporting body; and an electrical resistance adjustment layer laminated on the conductive supporting body and comprising a resin composition, wherein the resin composition comprises a thermoplastic resin having an ether group as a component of a resin matrix, and at least a polyketone fiber and an electrolytic salt are dispersed within the resin matrix.

2. The conductive member of claim 1, wherein the thermoplastic resin having the ether group is a polyether ester amide.

3. The conductive member of claim 1, wherein the electrolytic salt comprises at least one type of electrolytic salt selected from perchlorates and at least one type of electrolytic salt selected from organic anion salts containing fluorine.

4. The conductive member of claim 1, wherein the conductive member is a charging member of an image forming apparatus.

5. The conductive member of claim 4, wherein the conductive member is provided opposite an image carrier in the image forming apparatus and includes a space maintaining member to contact the image carrier at opposed ends of the electrical resistance adjustment layer and maintain a constant space between the image carrier and a surface of the conductive member between the opposed ends.

6. A process cartridge comprising the conductive member of claim 4.

7. An image forming apparatus comprising the conductive member of claim 4.

8. The conductive member of claim 1, wherein the polyketone fiber is configured of polyketone having approximately 95-100% by weight of repeating unit poly 1-oxotrimethylene as shown in the following formula:

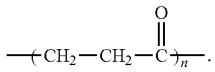

* * * * *